US005664678A

United States Patent [19]

Budowski et al.

[11] Patent Number: 5,664,678

[45] Date of Patent: Sep. 9, 1997

[54] FOLDABLE RETURNABLE SHIPPING CONTAINER

[76] Inventors: Allan Budowski, 6816 Bilberry Dr., Gloucester Ontario, Canada, K1C 3R4; Jeff Lambert, 338 Nagel Avenue, Cumberland, Ontario, Canada, K1E 1R6

[21] Appl. No.: 585,348

[22] Filed: Jan. 11, 1996

[51] Int. Cl.[6] ..... B65D 19/00

[52] U.S. Cl. ..... 206/600; 220/1.5; 220/7

[58] Field of Search ..... 206/386, 600, 206/597; 220/1.5, 4.28, 6, 7

[56] References Cited

U.S. PATENT DOCUMENTS

| | | | |
|---|---|---|---|
| 3,935,357 | 1/1976 | Podovani | 206/814 |
| 4,386,926 | 6/1983 | Heller | 229/930 |
| 4,413,737 | 11/1983 | Wind | 206/600 |
| 4,643,314 | 2/1987 | Kidd | 206/386 |
| 4,828,132 | 5/1989 | Francis, Jr. et al. | 220/6 |
| 4,880,141 | 11/1989 | Gossler et al. . | |
| 4,948,039 | 8/1990 | Amatangelo | 229/198 |
| 5,184,772 | 2/1993 | McGrath | 229/930 |
| 5,292,060 | 3/1994 | Focke et al. | 229/198 |
| 5,392,911 | 2/1995 | Gillispie et al. | 206/386 |
| 5,431,985 | 7/1995 | Schilling | 206/814 |
| 5,501,758 | 3/1996 | Nitardy | 229/930 |

OTHER PUBLICATIONS

Copy of Marketing Brochure with photograph of container.
Copy of Marketing Brochure with photographs of container, Perstorp Xytec, Inc.

*Primary Examiner*—Paul T. Sewell
*Assistant Examiner*—Nhan T. Lam
*Attorney, Agent, or Firm*—Neil Teitelbaum & Associates

[57] ABSTRACT

A returnable container suitable to be assembled to contain products, and to be disassembled for return shipping, comprises a molded base having a container bottom plate surrounded by an upstanding flange, a molded top closure having a container top plate surrounded by a depending flange, and a sleeve part suitable for providing sidewalls surrounding a space between the base and the top closure and having upper and lower margins suitable for being received within in the flanges. The sidewalls are each formed from plastic material having an outer sheet and an inner sheet held in spaced relation by a plurality of vertically orientated webs, and the sidewalls are connected by hinge sections comprising flexible continuations of the outer sheets of adjacent sidewalls which extend across gaps between inner sheets of adjacent sidewalls. The hinge sections are capable of forming rounded corners of the container when the container is erected and the hinge sections are also capable of forming 180° bends between adjacent sections, of which one is a reverse bend joining two of the sidewalls which are folded with their outer surfaces juxtaposed, so that for return shipping the sleeve can be folded substantially flat to occupy a space lying between the top and bottom plates and within the flanges of the collapsed base and top closure.

13 Claims, 8 Drawing Sheets

FOLDABLE RETURNABLE SHIPPING CONTAINER

FIELD OF THE INVENTION

The present invention relates to a shipping container of the type which can be disassembled after use and collapsed to a relatively small space for return to the shipper.

BACKGROUND OF THE INVENTION

In recent years there has been a trend towards avoiding the large amount of wastage which is normal with single use cardboard shipping containers by using containers of more durable material which can be disassembled after use, collapsed to a relatively small space, and returned to the shipper for re-use. One kind of durable material which has been used for this purpose is a double walled, fluted plastic material having an outer and an inner sheet which are joined together by a series of parallel webs integral with the outer and inner sheets; such material can be formed by extrusion. This material can be much stronger than cardboard, has energy absorbing properties, and is also waterproof. Suitable plastic is polypropylene. The use of such material for returnable shipping containers is shown for example in the following U.S. Pat. Nos.:

4,948,039, issued Aug. 14, 1990 to Amatangelo; and 5,292,060, issued Mar. 8, 1994 to Focke et at.

In both of these prior patents, the container is entirely formed from the double walled plastic material, and special provision is made to provide hinge joints between panels of the normally rigid material. However, in these constructions, the bottom of the container may be undesirably weak for heavy materials. Also, in both patents, at least some of the sidewalls have the webs extending horizontally rather than vertically; vertical webs would be preferable from the strength point of view, for resisting vertical loads, especially since it is usual to stack containers one on top of another.

SUMMARY OF THE INVENTION

The present invention provides a returnable container which uses double walled plastic material for the sidewalls, the material being used in such a way that the webs joining the inner and outer sheets are always vertical in the normal orientation of the container, and a relatively rigid molded base is used to hold the lower edges of the double walled plastic material. A relatively rigid top closure is also used, and this may have a rigidity sufficient to incorporate carrying handles. The whole container, when disassembled for return, takes up no more space than the base and top closure when collapsed together.

In accordance with the invention, a returnable container suitable to be assembled to contain products and to be disassembled for return shipping, comprises:

- a molded base having a container bottom plate surrounded by an upstanding flange;
- a molded top closure having a container top plate surrounded by a depending flange; and
- a sleeve part suitable for providing sidewalls surrounding a space between the base and the top closure and having upper and lower margins suitable for being received within in said flanges, said sleeve part also including hinge sections connecting said sidewalls.

The sidewalls are each formed from plastic material having an outer sheet and an inner sheet held in spaced relation by a plurality of vertically orientated webs, and the hinge sections comprise substantially single layer flexible panels including substantial continuations of the outer sheets of adjacent sidewalls. These continuations may extend across gaps between inner sheets of said adjacent sidewalls, as for example when the hinge sections are made by removing inner sheets from the material forming the sidewalls. Alternatively, the hinge sections may be formed by crashing together the outer and inner sheet. The hinge sections are capable of forming rounded corners of the container when the container is erected and the hinge sections are also capable of forming 180° bends between adjacent sections, of which one is a reverse bend joining two of the sidewalls when folded with their outer surfaces juxtaposed, so that the sleeve can be folded substantially flat to occupy an area lying within the flanges. The base and top closure flanges are arranged to provide a hollow space between the top and bottom plates when the container is disassembled, the hollow space being capable of accommodating the sleeve part when folded.

The hinge sections preferably include a plurality of spaced vertical ribs connected to the continuations of the outer sheets; this gives these sections strength to resist vertical forces, while allowing flexibility in the lateral direction. The rounded corners have a radius of curvature of more than 1 inch, and preferably more than 1.5 inches.

The container base may have downwards hollow projections corresponding to the corners of the container, each projection having a drainage hole which allows water which has entered the base to drain out of the base.

BRIEF DESCRIPTION OF THE DRAWINGS

Preferred embodiments of the invention will now be described by way of example with reference to the accompanying drawings, in which.

DETAILED DESCRIPTION

Figure 1:
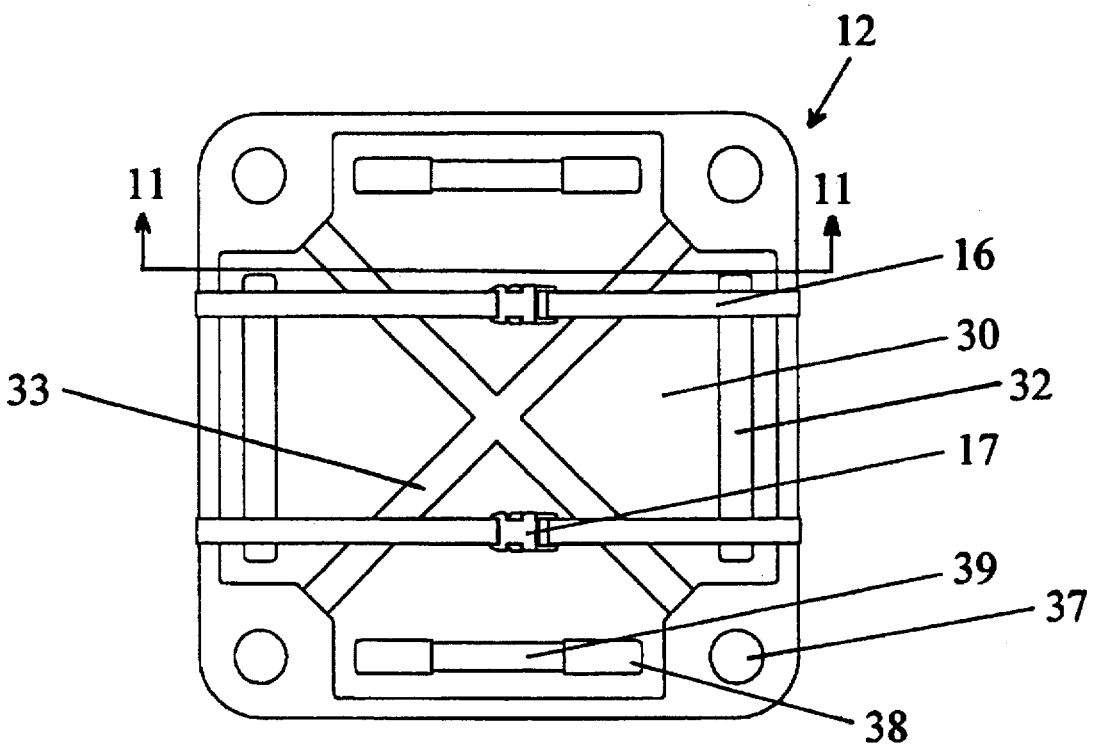
FIG. 1 is a top view of a first embodiment of a container when assembled.
Figure 2:
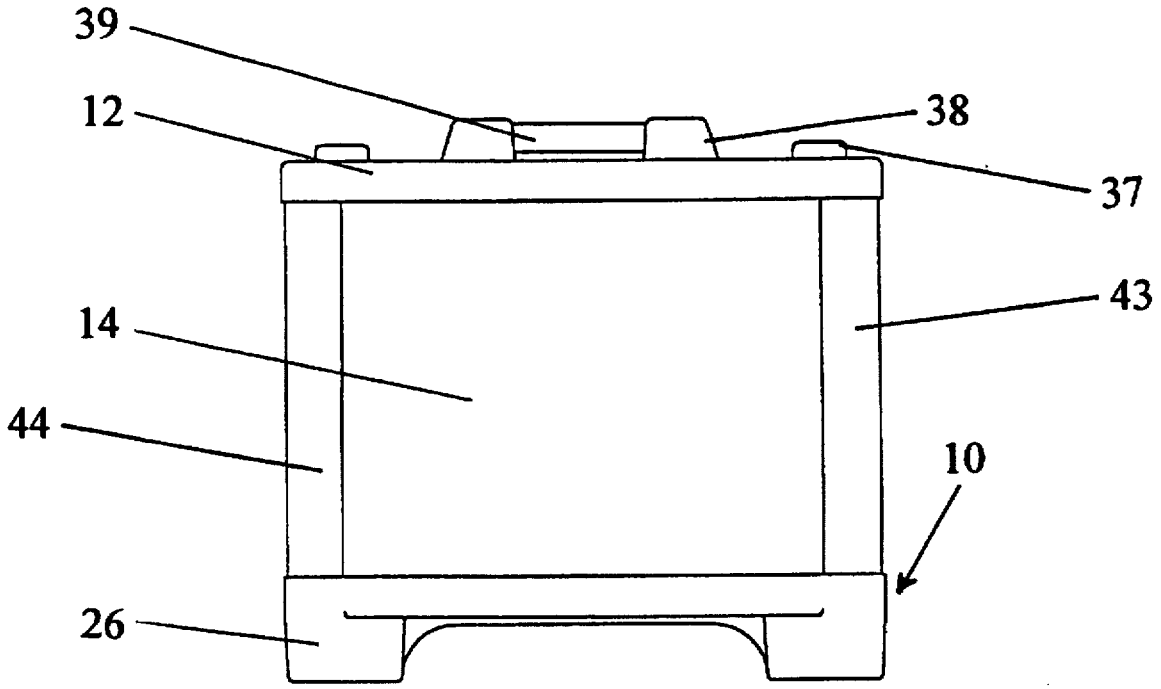
FIG. 2 is a side view of the same container when assembled.
Figure 3:
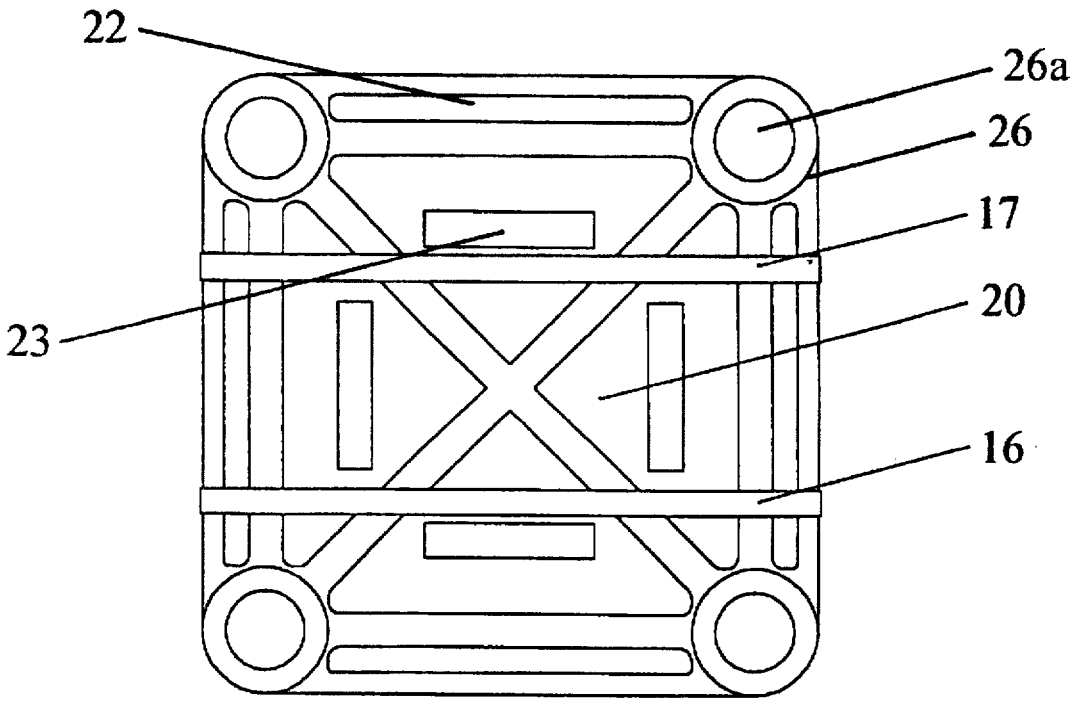
FIG. 3 is a bottom view of the same container when assembled.

Referring to FIGS. 1 to 7 showing the first embodiment, the container basically comprises a rigid molded base part 10, a rigid molded top closure 12, and a sleeve part 14 which surrounds the space between the base part and the top closure. The parts may be held together by straps 16 having buckles 17.

Figure 4:
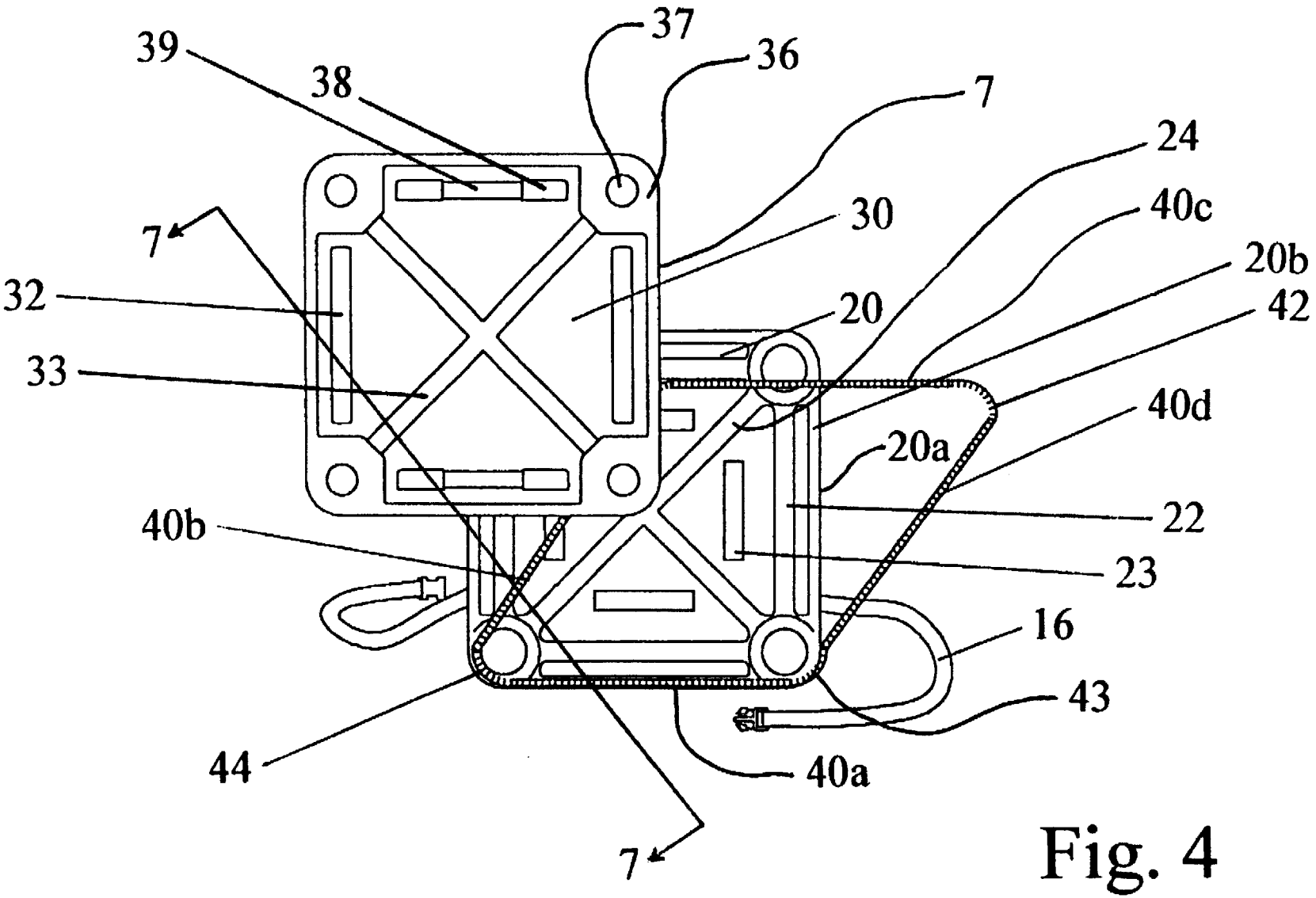
FIG. 4 is a top view of the container partly disassembled.
Figure 7:
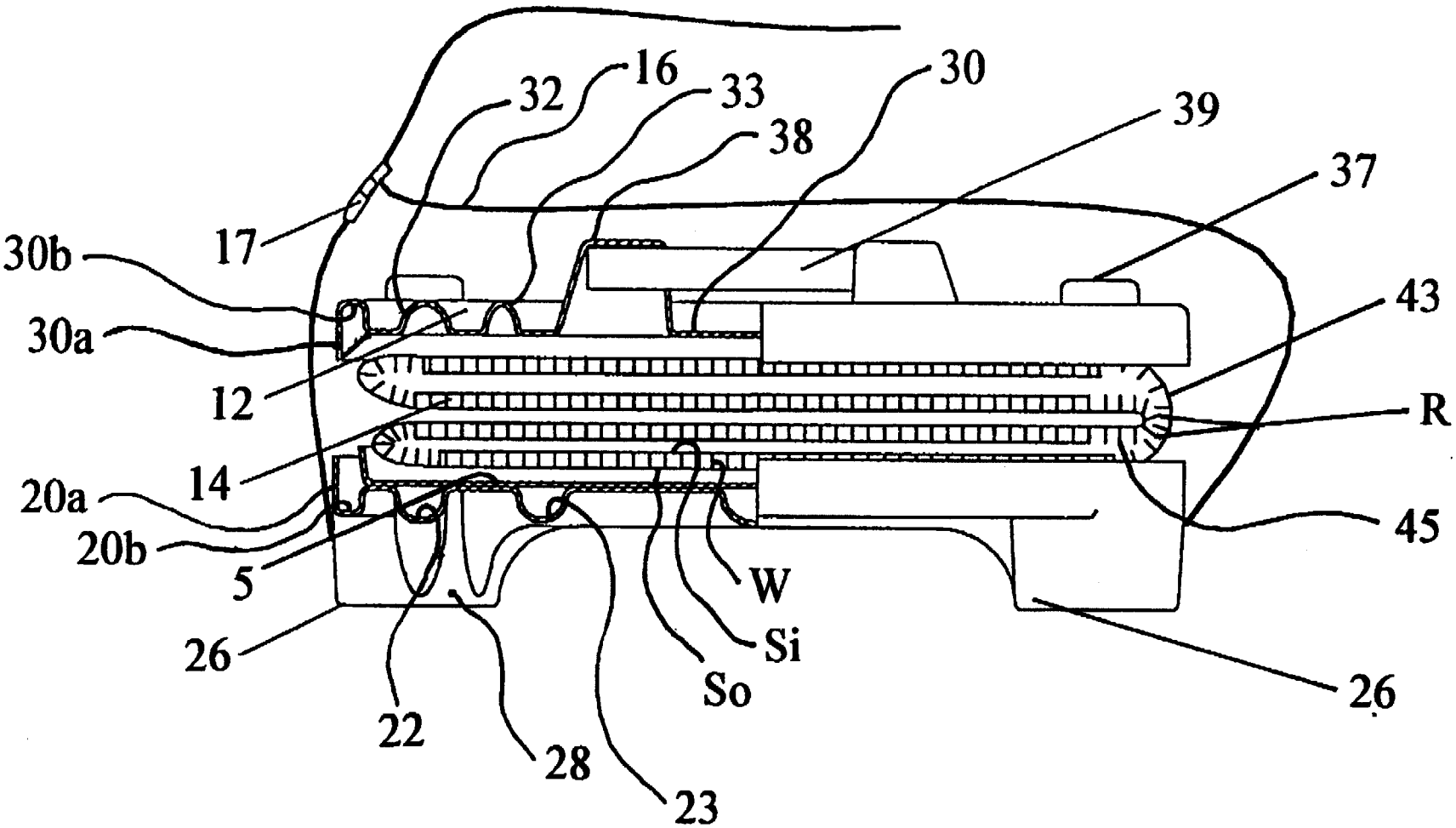
FIG. 7 is a view of the container parts being packaged for return to a shipper, partially sectioned on lines 7—7 of FIG. 4.

Details of the base part 10 and the top closure 12 are shown in FIGS. 4 and 7. Both of these parts are molded of rigid plastic, for example high density polyethylene. The base part comprises a generally square, planar bottom plate 20 surrounded by a continuous upstanding flange 20*a*, the central portion of each side of the plate 20 being separated from the flange by an upwardly open channel 20*b*. The plate also has channels 22, 23 and 24 formed integrally therein for added rigidity. At each corner of the base part is a hollow cup-shaped projection 26 which serves to hold the bottom plate about 1.5 to 2 inches above a supporting floor, to allow the prongs of a forklift truck to be inserted under the container. Each projection 26 has a reentrant, raised circular central area 26*a* which provides a downwardly open recess. The projections 26, which have a diameter of several inches, have an outwardly facing surface which is a continuation of the rounded corner of the flange 20*a*.

The projections 26 are also provided with small drain holes 28 near to their lowest extremities. These allow drainage of any water which inadvertently enters the container, and ensures that any such water does not damage the container contents.

The top closure is similar to the base part in outline shape and size, also having a plate 30 with a surrounding flange 30*a*. At each side of the closure the flange 30*a* is separated from the main area of the plate by downwardly open channel 30*b*. The plate 30 also has downwardly open channels 32, 33 for added rigidity. At its corners, the top plate has raised areas 36 provided with hollow upstanding hollow studs 37 which are positioned and sized so as to fit within the recesses provided by raised areas 26*a* of any like container which is stacked on top; in other words the studs 37 and the recesses under raised areas 26*a* provide registration means for containers when stacked one above the other. In addition, the top closure has pairs of upstanding hollow projections 38 positioned on opposite sides of the top plate, with each pair of projections holding the end portions of a rod-like carrying handle 39.

The sleeve part 14 is shown in the erected state in FIG. 1, and in various conditions of folding in FIGS. 4 to 7. It has four semi-rigid sidewalls 40*a*, 40*b*, 40*c*, and 40*d*, corresponding to the straight side portions of the base and top closure, and these are connected together by four flexible hinge potions 42, 43, 44, and 45. The sidewalls are each formed of double walled plastic material, of the type described above, having an outer sheet So, an inner sheet Si, and an integral web W connecting the two sheets, the webs of all the sidewalls being vertical in the normal orientation of the container as shown. The flexible hinge potions are narrow, normally vertical panels each formed from a continuation of the outer sheet So which extends across a gap between edges of adjacent inner sheets Si of the sidewalls. These continuations of the outer sheet preferably have vertical ribs R projecting from their inner surfaces, corresponding to webs W. It will be apparent that the sleeve can be formed from a single piece of the double walled plastic material by removing the inner sheet from the panel areas intended to form hinge sections, and connecting opposite ends of the sheet, for example using a joint in which the outer sheet So of one end of the piece overlaps with and is attached to inner parts of the other end of the piece. Alternatively, the double walled plastic material can be heated, pressed and collapsed to form a hinge section. In yet an alternative embodiment (not shown), ribs can be formed into the heated collapsed material so that ribs are formed on the inner wall that allow hinging of the corner sections while providing additional strength of the heated collapsed hinged portions.

Figure 5:
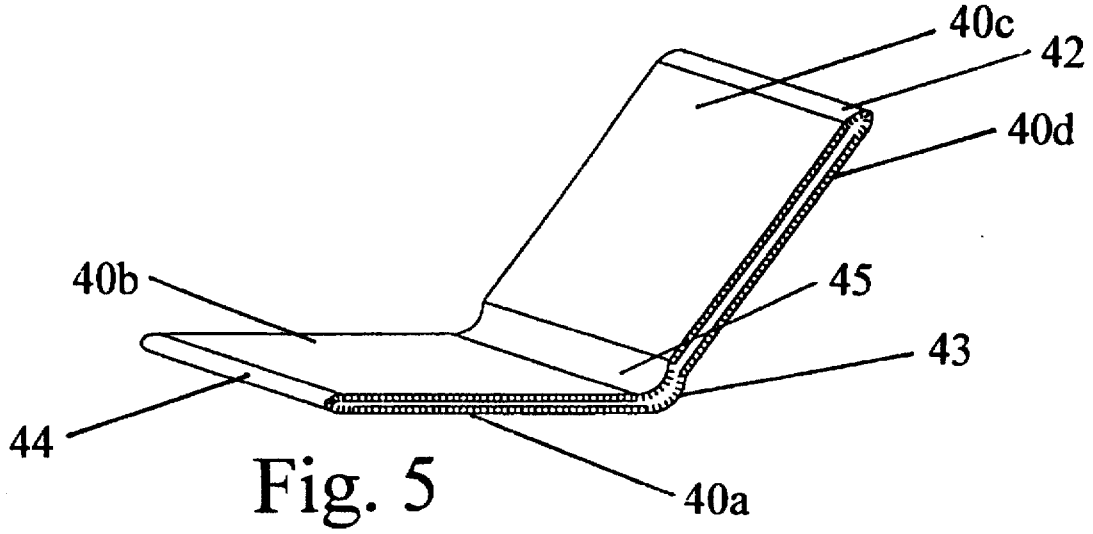
FIGS. 5 and 6 are perspective views of the sleeve part during folding.
Figure 6:
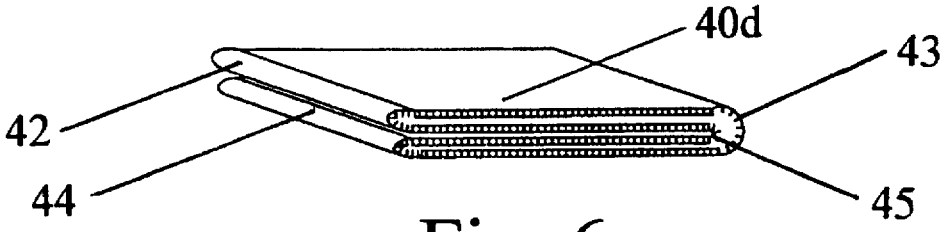

The flexibility of the hinge sections formed as described allows, firstly, the sections to form rounded 90° angles, corresponding to the curvature of the corners of the base and top closure, when the container is assembled. These corners have a radius of more than 1 inch, and preferably of more than 1.5 inches, and bends of this kind do not materially weaken the plastic. As shown in FIGS. 5 to 7, the hinge sections 42, 43 and 44 are suitable for flexing from the 90° included angle condition of the erected condition down to 0° when the sleeve is initially collapsed, as indicated in FIG. 5. Furthermore, at least the hinge section 45 is capable of being reversely bent from the flat condition through an angle of 180° to connect two sidewalls 40*b* and 40*c* when these are folded with their outer surfaces brought together. This allows the sleeve to be folded into a condition in which, as shown in FIG. 7, it fits within the flanges of the base part and the top closure, when these have been collapsed together as shown in FIG. 7 this requires hinge section 45 to bend through 270° in going from the erected to the folded state.

The use of the double walled material as shown, with the webs W always vertical, and with the flexible corners also reinforced by ribs R, provides a good stacking strength for the container this requires hinge section 45 to bend through 270° in going from the erected to the folded state.

As mentioned, the container also includes a pair of straps 16, with adjustable buckles 17. These can be used at their full length for holding the assembled container parts together, as shown in FIG. 1, and can also be used as indicated in FIG. 7 to hold the parts of the collapsed container together. When the straps have been tightened from the FIG. 7 condition, the adjacent edges of flanges 20*a* and 30*a* are brought together to provide a compact package.

As shown in FIG. 7, the container may also include a generally flat tray 50, overlying the bottom plate 20 and providing additional strength. This tray however is optional.

Figure 8:
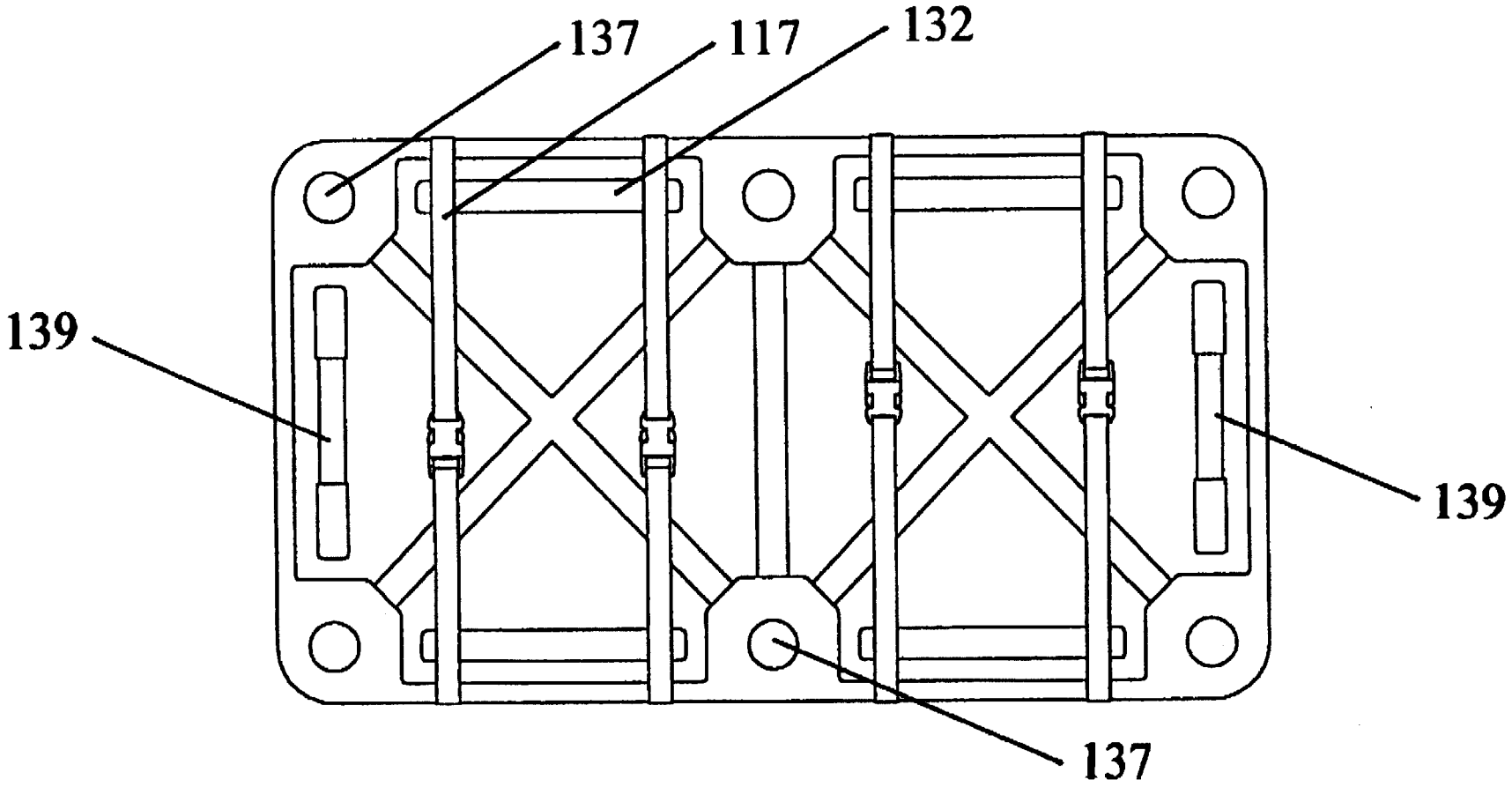
FIGS. 8–10 are views similar to FIGS. 1–3 of a second embodiment of a container.
Figure 9:
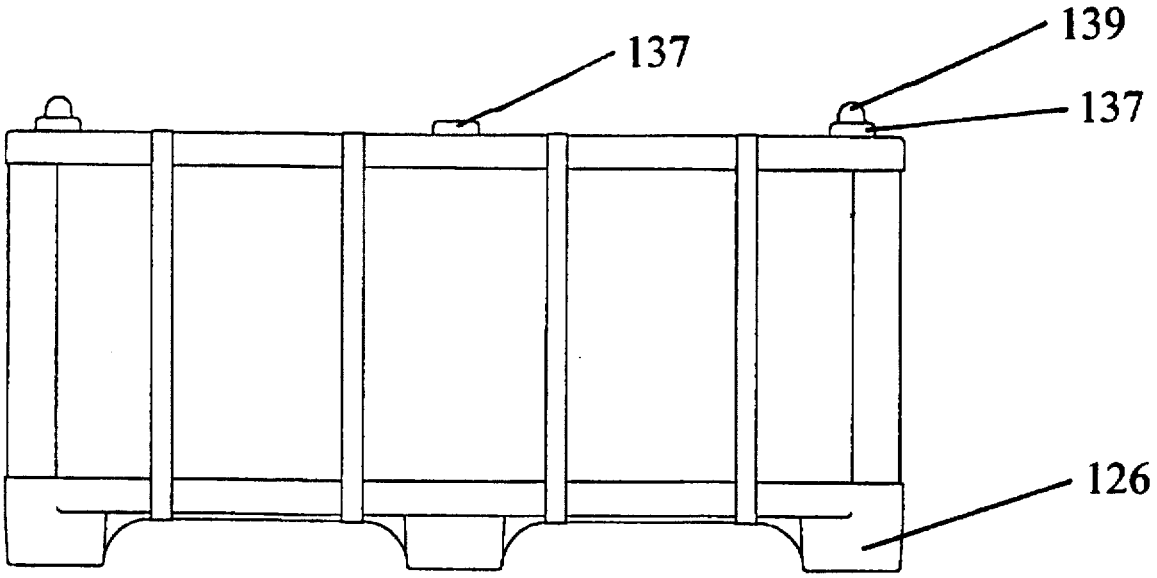
Figure 10:
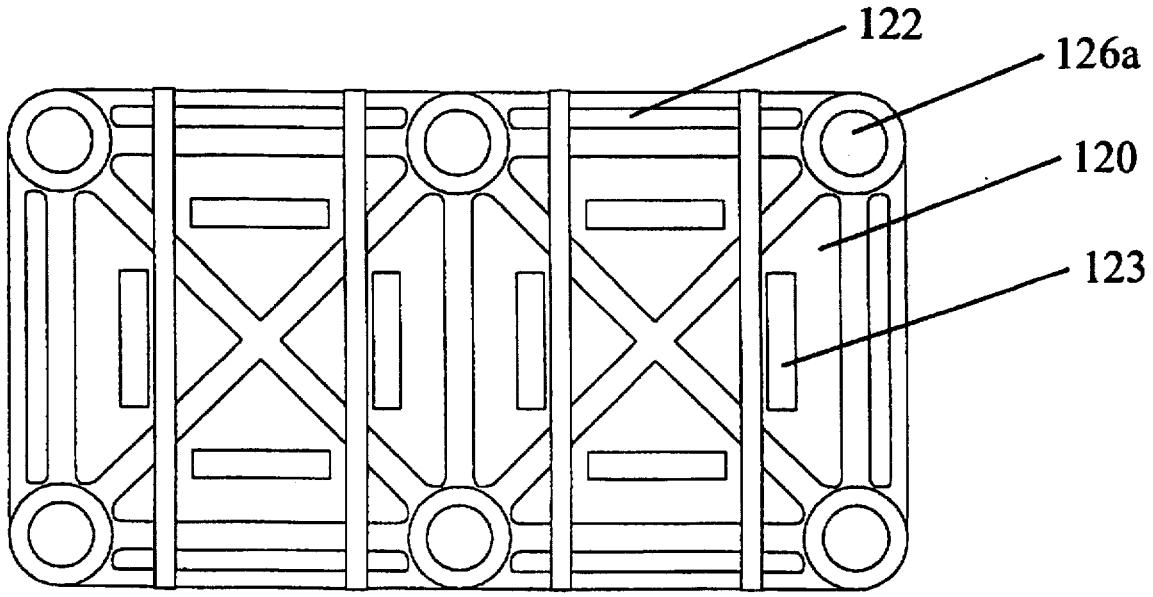
Figure 11:
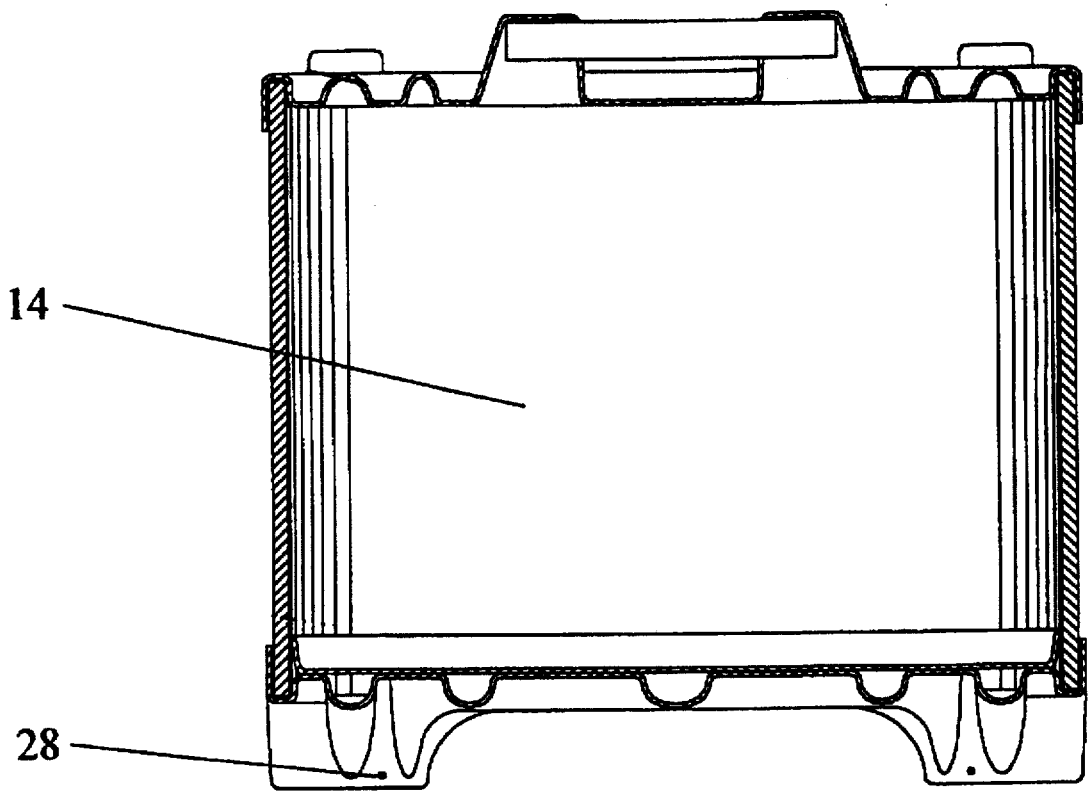
FIG. 11 is a sectional elevation of the first embodiment of the container along lines 11—11 of FIG. 1.

FIGS. 8 to 10 show a generally similar container to that described above, except that it is rectangular instead of square. In these figures, parts corresponding to those of FIGS. 1 to 7 are similarly referenced, but with reference numbers increased by 100. It may be seen that in this embodiment the two carrying handles 139 are placed one at each end of the container.

Figure 12:
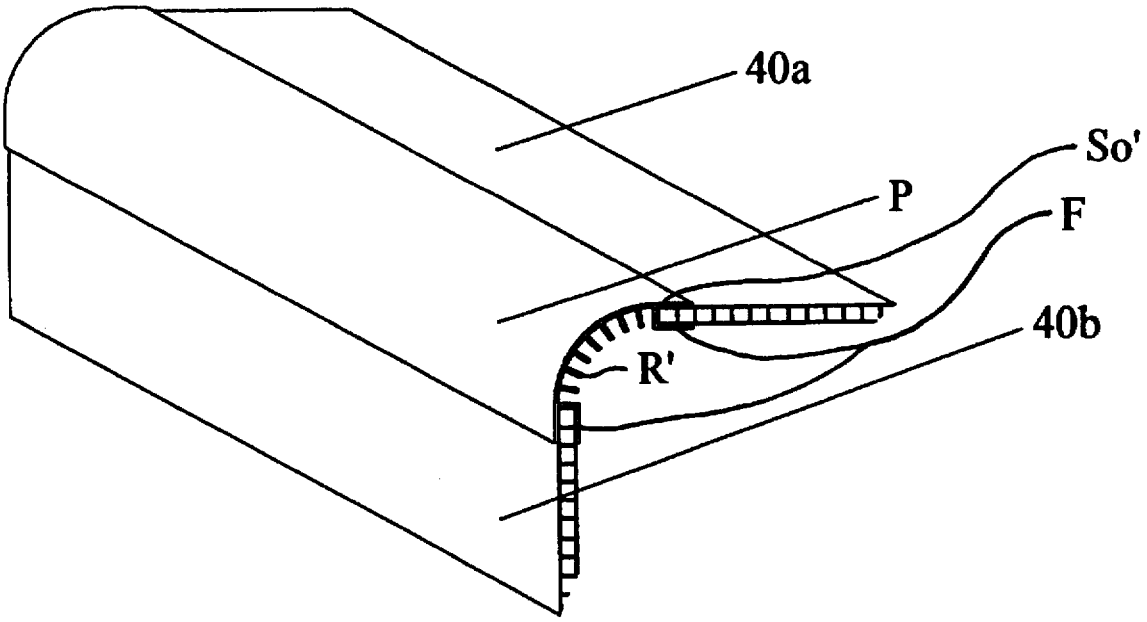
FIG. 12 is a view of a modified form of the hinge section joining two sidewalls.

FIG. 12 shows a view of a connecting panel P which can serve both as one of the hinge sections of a container, and as a connector between the end edges of a sheet of double walled plastic material forming the sleeve 14, and having end side wall panels 40*a* and 40*b*. The panel P has an outer sheet So' with inwardly projecting ribs R', and has edges formed with angled flanges F which, together with a portion of outer sheet So, form pockets for retaining the edges of the panels 40*a* and 40*b*. It will be apparent that panel P, in which sheet So' provides a substantial continuation of the outer sheets of the adjacent sidewall panels, instead of being used only at one corner of the container, could alternately be used at each corner of the container.

Figure 13:
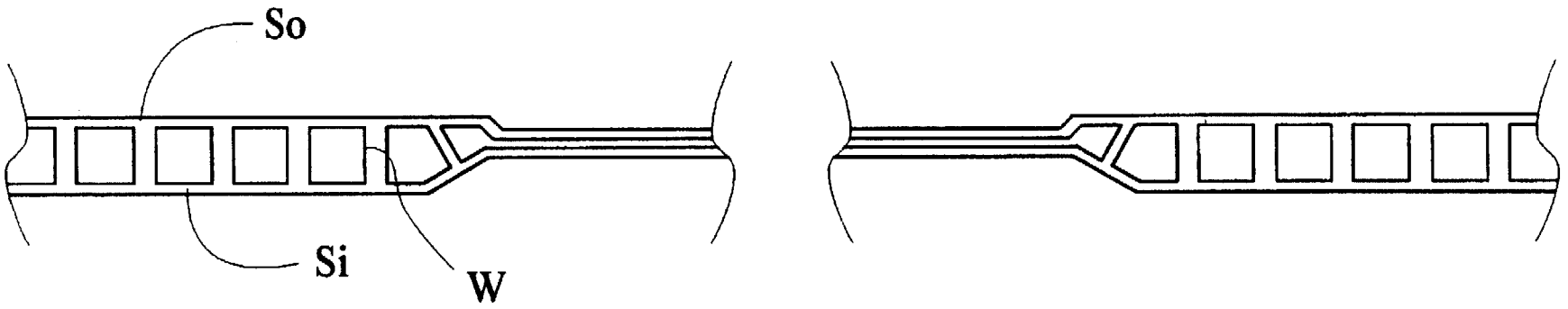
FIGS. 13 and 14 show further modified forms of the hinge sections.
Figure 14:
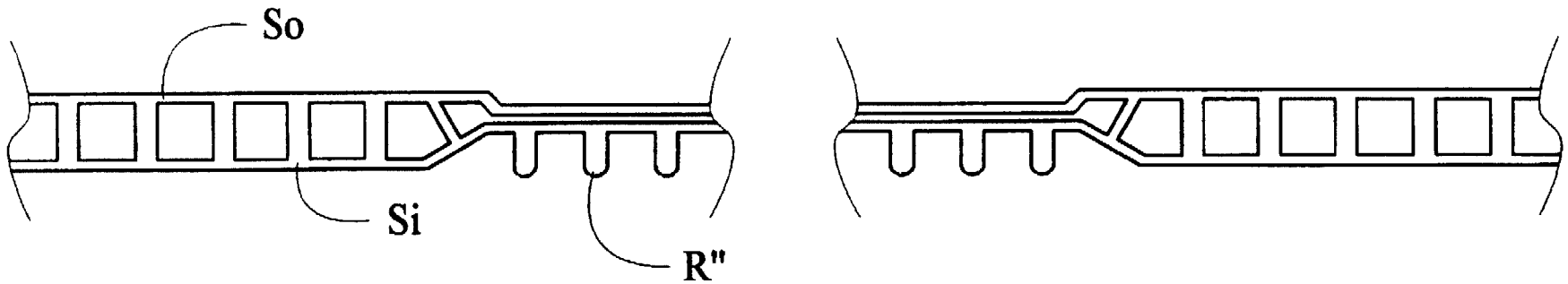

FIGS. 13 and 14 show further alternative forms of hinge section. In FIG. 13, the hinge section has been formed by heating the section of material and pressing together, between dies, the inner and outer sheets Si and So, the webs W being crushed in between. The hinge section thus includes continuations of both the inner and outer sheets. The form shown in FIG. 14 is formed in a generally similar manner, except that the die forming the inner sheet Si is provided with grooves that form ribs K" on the inner sheet. In each case a substantially single layer, flexible panel is provided, which includes substantial continuations of the outer sheet So.

Of course, numerous other embodiments may be envisaged without departing from the sprit and scope of the invention.

What we claim is:

1. A returnable container having an assembled mode for containing products and a disassembled mode for return shipping, comprising:

a molded base having a container bottom plate surrounded by an upstanding flange;

a molded top closure having a container top plate surrounded by a depending flange;

a sleeve part comprising:

a plurality of sidewalls which, when the container is in the assembled mode, surround a space between the molded base and the molded top closure, said sidewalls having upper and lower margins for being received within said flanges, said plurality of sidewalls each being formed from plastic material having an outer sheet and an inner sheet held in spaced relation by a plurality of vertically oriented webs, and hinge portions each connecting pairs of said plurality of sidewalls, each hinge portion comprising a substantially single layer flexible panel portion including substantial continuations of at least the outer sheets of the plurality of sidewalls adjacent to said hinge portion, said hinge portions for forming rounded corners of the container when the container is in the assembled mode and said hinge portions, when the container is in the disassembled mode, for forming bends at 180° from the flat condition between adjacent sections, of which one bend joins two of said plurality of sidewalls when folded with their outer surfaces juxtaposed, wherein said base and top closure flanges are arranged to provide a hollow space between said top and bottom plates when the container is in the disassembled mode, said hollow space for accommodating the sleeve part when folded and, wherein the sleeve is for folding substantially flat to occupy an area within the hollow space when the container is in the disassembled mode.

2. A returnable container according to claim 1, wherein said hinge portions which form substantial continuations of the outer sheets have a plurality of spaced vertical ribs connected thereto.

3. A returnable container according to claim 1, wherein the hinge portions comprise a heated, pressed, and collapsed portion of said inner and outer sheets, said hinge portions producing rounded corners when the container is in the assembled mode with said molded base and said molded top closure having a radius of curvature of more than 1 inch.

4. A returnable container according to claim 1, wherein said base and top closure include grooves for locating the upper and lower margins of the sleeve.

5. A returnable container according to claim 1, wherein said base and top closure are substantially square with rounded corners, the container having four of said sidewalls of substantially the same width.

6. A returnable container according to claim 1, wherein said corners have a radius of curvature of more than 1 inch.

7. A returnable container according to claim 1, wherein said corners have a radius of curvature of more than 1.5 inches.

8. A returnable container according to claim 1, wherein the base has downwards hollow projections at each corner of the container, and each said projection has a drainage hole which allows water which has entered the base to drain out of the base.

9. A returnable container according to claim 1, further comprising a tray which fits within the flanges of the base and which provides additional support for products in the container.

10. A returnable container according to claim 1, wherein the top closure has, at opposite sides, a pair of upstanding hollow projections, which between them support a handle for lifting the container.

11. A returnable container according to claim 1, when in disassembled form with the hollow space between the base and top plates occupied by the folded sleeve part.

12. A returnable container according to claim 1, wherein in both assembled mode and disassembled mode the returnable container is substantially weatherproof in an upright orientation.

13. A returnable container for assembly to contain products and to be disassembled for return shipping, comprising:

a molded base having a container bottom plate surrounded by an upstanding flange;

a molded top closure having a container top plate surrounded by a depending flange;

a sleeve part comprising:

a plurality of sidewalls for surrounding a space between the molded base and the molded top closure and having upper and lower margins for being received within said upstanding and depending flanges, each of said plurality of sidewalls being formed from plastic material having an outer sheet and an inner sheet held in spaced relation by a plurality of vertically oriented webs, and hinge portions each connecting pairs of said plurality of sidewalls along an axis parallel to said plurality of vertically oriented webs, each hinge portion comprising a substantially single layer flexible panel portion contiguous with at least the outer sheets of adjacent sidewalls, said hinge portions forming rounded corners of the container when the container is erected and said hinge portions also forming bends at 180° from the flat condition between adjacent sections, of which one bend joins two of said plurality of sidewalls when folded with their outer surfaces juxtaposed, wherein said sleeve is foldable substantially flat to occupy an area lying within said flanges, and wherein said base and top closure flanges are arranged to provide a hollow space between said top and bottom plates when the container is disassembled, said hollow space being capable of accommodating the sleeve part when folded.

* * * * *